US005309842A

United States Patent [19]

Matysik et al.

[11] Patent Number: 5,309,842

[45] Date of Patent: May 10, 1994

[54] DEVICE FOR FIRING A DIABOLO FORM BULLET FROM A FIREARM

[75] Inventors: Peter Matysik, Springe; Walter Heitz, Rastatt, both of Fed. Rep. of Germany

[73] Assignees: Wilhelm Brenneke KG Fabrikation von Jagdgeschossen, Langenhagen; Dianawerk GmbH & Co. KG, Rastatt, both of Fed. Rep. of Germany

[21] Appl. No.: 965,225

[22] Filed: Oct. 23, 1992

[30] Foreign Application Priority Data

Oct. 25, 1991 [DE] Fed. Rep. of Germany ..... 4135248

[51] Int. Cl.[5] ..... F42B 5/00; C06D 5/00

[52] U.S. Cl. ..... 102/430; 102/447; 102/530

[58] Field of Search ..... 102/430, 444–447, 102/464, 466, 467, 469, 470, 481, 530, 531, 439

[56] References Cited

U.S. PATENT DOCUMENTS

| | | | |
|---|---|---|---|
| 1,817,273 | 8/1931 | Schuler | 102/444 |
| 2,865,456 | 12/1958 | Dennis | 102/530 |
| 3,628,225 | 12/1971 | Parker | 102/530 |
| 3,771,451 | 11/1973 | Woodring | 102/430 |
| 3,882,778 | 5/1975 | Gawlick et al. | 102/466 |
| 4,676,164 | 6/1987 | Carter et al. | 102/470 |
| 4,681,038 | 7/1987 | Washburn | 102/464 |
| 4,899,660 | 2/1990 | Brighton | 102/444 |
| 4,899,663 | 2/1990 | Thorn | 102/530 |
| 4,958,567 | 9/1990 | Olson | 102/444 |
| 5,016,536 | 5/1991 | Brighton | 102/444 |

FOREIGN PATENT DOCUMENTS

| | | | |
|---|---|---|---|
| G011356 | 8/1956 | Fed. Rep. of Germany | 102/464 |
| 408214 | 3/1910 | France . | |
| 1544181 | 10/1968 | France | 102/444 |
| WO91/14916 | 10/1991 | PCT Int'l Appl. | 102/444 |
| 20469 | of 1903 | United Kingdom | 102/470 |

OTHER PUBLICATIONS

European Search Report, Jan. 28, 1993 for European Patent Application EP 92 11 7602.

*Primary Examiner*—Harold J. Tudor
*Attorney, Agent, or Firm*—Michael J. Striker

[57] ABSTRACT

The device for firing a diabolo form bullet from a firearm with a rifled barrel consists of a cartridge having a housing, a detonation cap connected to one end of the housing in a gas-tight manner and containing a gas-forming propellant, the housing having an expansion compartment for expansion of a gas produced on ignition of the gas-forming propellant and an outer surface tapered toward another end of the housing remote from the detonation cap, the tapered outer surface aligning the diabolo form bullet loaded coaxially in the rifled barrel by engaging a tapered recess provided in the diabolo form bullet, whereby the diabolo form bullet is forced into the rifled barrel so as to calibrate the diabolo form bullet; and a membrane covering the other end of the housing remote from the detonation cap. The housing is provided with at least one breakthrough region, which ruptures when a gas pressure on ignition exceeds a predetermined maximum value.

5 Claims, 3 Drawing Sheets

DEVICE FOR FIRING A DIABOLO FORM BULLET FROM A FIREARM

BACKGROUND OF THE INVENTION

The present invention relates to a device for firing a diabolo form bullet from a firearm with which the bullet is propelled from the barrel of the firearm after ignition of a gas-producing propellant means in a detonator cap.

In practice in some instances the inertia of the bullet is not overcome by the high pressure due to the gas generation from the gas-producing propellant means after ignition so that the bullet is damaged or destroyed on firing the firearm.

SUMMARY OF THE INVENTION

It is an object of the present invention to provide an improved device for firing a diabolo form bullet from a firearm so that the bullet remains undamaged despite the high pressure which arises on ignition of the gas-generating propellant means.

This object, and others which will be made more apparent hereinafter, are attained in a device for a firearm, with which a bullet is propelled from the barrel of the firearm after ignition of a gas-producing propellant means in a detonator cap of the firearm.

According to the invention the device for firing a diabolo form bullet from a firearm with a rifled barrel consists of a cartridge comprising a housing, a detonation cap connected to one end of the housing in a gas-tight manner and containing gas-forming propellant means, the housing having an expansion compartment for expansion of a gas produced on ignition of the gas-forming propellant means and an outer surface tapered toward another end of the housing remote from the detonation cap, the tapered outer surface aligning the diabolo form bullet loaded coaxially in the rifled barrel by engaging a tapered recess provided in the diabolo form bullet, whereby the diabolo form bullet is forced into the rifled barrel so as to calibrate the diabolo form bullet; and a membrane covering the other end of the housing remote from the detonation cap. Furthermore the housing is provided with at least one breakthrough region, which ruptures when a gas pressure of the gas generated on ignition of the gas-forming propellant means exceeds a predetermined maximum value. Because of the presence of the expansion compartment in the cartridge, the pressure of the gas produced by the propellant means on the bullet, also the pressure wave acting on the bullet, is strongly decreased or attenuated and the time at which it acts on the bullet is delayed, so that the pressure acting on the bullet is always kept within acceptable limits.

The size of the expansion chamber depends on the circumstances and it can be determined empirically by experiment. In certain situations a volume of about 100 $mm^3$ has proved to be suitable.

As gas-producing propellants the following materials can be used: picric acid, triazinate, tetrazene, barium nitrate, calcium silicide, lead azide and lead resorcinate. However the invention is not limited to these materials.

In an advantageous preferred embodiment baffle means are arranged in the compartment for gas expansion, which effect the gas pressure build-up on the bullet in a beneficial way.

When a filter is used to provide baffle means, one has the additional possible advantage of retaining residual waste materials, e.g. in the form of an ash residue, contained in the gas formed by the propellant means on ignition.

Advantageously the end of the cartridge next to or closest to the bullet is covered by a thin membrane to prevent residual waste materials from entering the expansion compartment from the outside and to make changes in the charge in the cartridge difficult.

According to another feature of the invention at least one breakthrough region is provided in the cartridge, which corresponds to a freely selectable maximum pressure in the cartridge. This breakthrough region is of particular significance, when performance is improved by change of the amount of propellant means located in the ignition cap or by addition to the expansion compartment.

The device according to the invention can be used for a number of purposes, e.g. in the pest control area. Also it is conceivable to use it in powered vehicle application for activation of some of the switching and control processes.

BRIEF DESCRIPTION OF THE DRAWING

The objects, features and advantages of the present invention will now be illustrated in more detail by the following detailed description, reference being made to the accompanying drawing in which.

DETAILED DESCRIPTION OF THE PREFERRED EMBODIMENT

Figure 1:
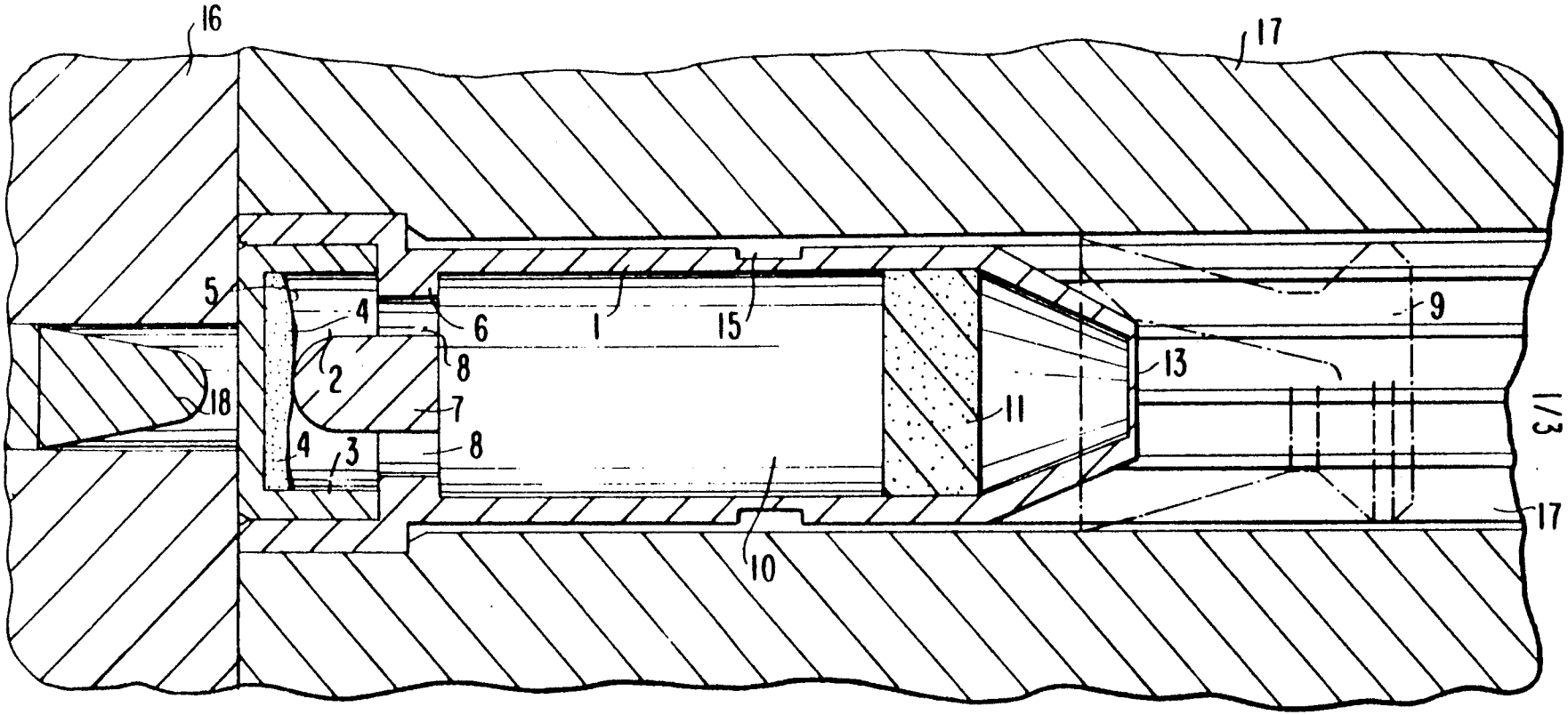
FIG. 1 is a vertical cross-sectional, view through a first embodiment of a device according to the invention, in which the bullet is shown with a dot-dashed line.

One embodiment of the device for firing a diabolo form bullet from a firearm, e.g. an air gun, is shown in FIG. 1. The device includes a barrel 17 with grooves 25 and a cartridge 1 which is inserted in the barrel 17. The cartridge has a housing 6. The firearm also has a breech-block 16 for loading, a firing pin 18 and the cartridge 1 has a detonation cap 2 which in the illustrated embodiment comprises a deep-drawn cup 3 made of metal, which holds a gas-producing propellant means 4. This gas-producing propellant means 4, which can be for example picric acid, triazinate, tetrazene, barium nitrate, calcium silicide, lead azide and lead resorcinate, is covered by a film 5 to keep out harmful environmental influences coming in from the front. The detonation cap 2 is inserted in a lower end of the housing 6, one of whose components is a detonator anvil 7, which is surrounded by several throughgoing passages 8 concentric to it, through which the gas generated by the propellant means on ignition passes.

Figure 2:
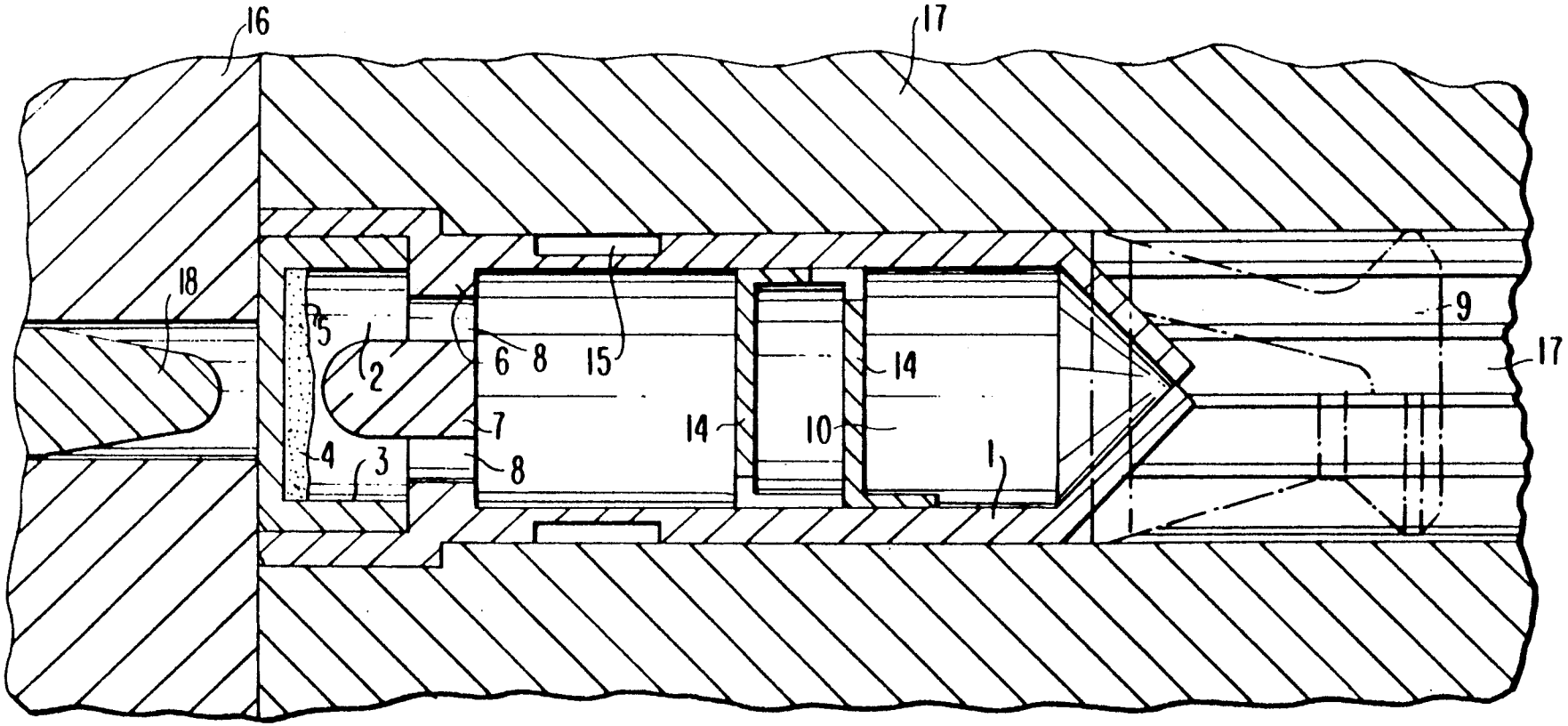
FIG. 2 is a vertical cross-sectional view through a second embodiment of a device according to the invention, in which the bullet is shown with a dot-dashed line.

A diabolo form bullet 9 is shown with a dot-dashed line in FIGS. 1 and 2. An expansion compartment 10 is provided in the housing 6 between the bullet 9 and the detonation cap 2, in which, according to its size, the gases entering through the passages 8 are depressurized so that the bullet 9 remains undamaged in all cases. The housing 6 has on its head end remote from the lower end a conical outer surface 20.

Suitable baffle means are provided in the expansion compartment 10. In the actual embodiment shown in FIG. 1 a filter 11 is selected as the baffle means. This filter 11 keeps back ash residue and prevents the addition of energy rich materials, e.g. nitrocellulose powder, to the charge.

In the embodiment shown in FIG. 2 the filter is omitted and the baffle means is indicated with reference number 14.

According to the embodiment of FIG. 1 the end of the cartridge closest to the bullet is covered with a thin-walled membrane 13.

To prevent undesirable consequences of possible changes or manipulation of the cartridge, breakthrough regions 15 are provided in the cartridge, which conduct the gases produced by the propellant means away in suitable channels in the barrel of the firearm when a predetermined maximum pressure is exceeded in the cartridge.

The charging and operation of the firearm is as follows:

First the breechblock 16 of the gun is opened and the bullet 9 is inserted into the barrel by pressing the cartridge 1 forward so that precalibration occurs. Subsequently the cartridge 1 is inserted in the barrel 17 as shown in FIGS. 1 and 2. In this process the conical outer surface 20 of the housing 6 of the cartridge 1 engages in a conical recess 21 in the rear portion of the diabolo shaped bullet 9 and centers it because of the interaction of both conical surfaces 20,21 in the barrel 17. At the same time the diabolo form bullet 9 is pressed into the grooves 25 of the barrel 17 and thus is calibrated in the barrel 17. The charging process is ended when the cartridge 1 comes to rest in the barrel 17 in the position shown in FIGS. 1 and 2. Then the breechblock 16 is closed. By releasing the firing pin 18 and impact against the detonation cap 2 the propellant means is ignited producing the propellant gas. The propellant gas formed travels through the passages 8 into the expansion chamber 10. The gas acts on the bullet 9 so that damage or destruction of the bullet is avoided in all situations.

Figure 3:
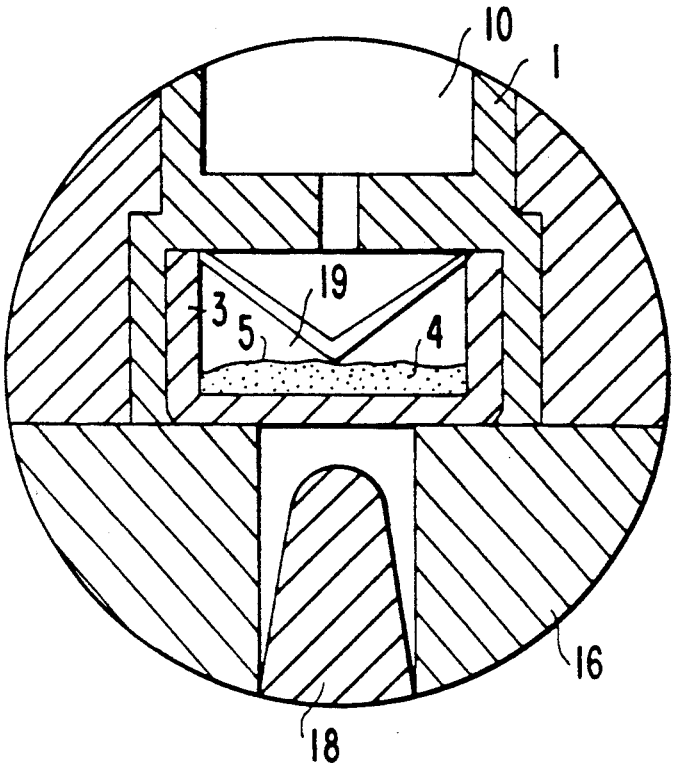
FIG. 3 is a detailed cross-sectional view of another embodiment of a device of the invention in the vicinity of the detonation cap.

In the embodiment according to FIG. 3 the detonator anvil 7 is replaced by an insert element 19, which has arms inclined outwardly, which are connected rigidly at one of their ends to the cup 3.

It will be understood that each of the elements described above, or two or more together, may also find a useful application in other types of structures differing from the types described above.

While the invention has been illustrated and described as embodied in a cartridge for a firearm, it has not been intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

We claim:

1. Device for firing a diabolo form bullet from a firearm with a rifled barrel, wherein said device consists of a cartridge comprising a housing, a detonation cap connected to one end of the housing in a gas-tight manner, said detonation cap containing a gas-forming propellant means, said gas-forming propellant means providing the sole source of gas in said cartridge on ignition of the gas-forming propellant means, said housing having an expansion compartment for expansion of said gas and said housing having an outer surface tapered toward another end of said housing remote from said detonation cap, said tapered outer surface aligning said diabolo form bullet loaded coaxially in said rifled barrel of said gas pressure operated fire arm by engaging a tapered recess provided in said diabolo form bullet, whereby said diabolo form bullet is forced into said rifled barrel so as to calibrate said diabolo form bullet; and a membrane covering said other end of said housing remote from said detonation cap, wherein said housing has at least one breakthrough region, in addition to said membrane, said at least one breakthrough region rupturing when a gas pressure of said gas generated on ignition of the gas-forming propellant means exceeds a predetermined maximum value.

2. Device as defined in claim 1, wherein the gas-forming propellant means is selected from the group consisting of picric acid, triazinate, tetrazene, barium nitrate, calcium silicide, lead azide and lead resorcinate.

3. Device as defined in claim 1, further comprising baffle means in the expansion compartment for expansion of the gas produced by the gas-forming propellant means.

4. Device as defined in claim 3, wherein the baffle means comprises a filter located in the expansion compartment.

5. Device as defined in claim 1, further comprising a film covering said gas-forming propellant means in said detonation cap to exclude environmental influences.

* * * * *